US010234106B2

(12) United States Patent
Wang et al.

(10) Patent No.: US 10,234,106 B2
(45) Date of Patent: Mar. 19, 2019

(54) DOUBLE-PRISM ASSEMBLY, MULTI-PRISM COMBINATORIAL STRUCTURE AND LIGHT FIXTURE

(71) Applicant: Guangzhou GTD Lighting Technology Co., Ltd., Guangdong (CN)

(72) Inventors: Zeru Wang, Guangdong (CN); Xiang Li, Guangdong (CN); Long Chen, Guangdong (CN)

(73) Assignee: Guangzhou GTD Lighting Technology Co., Ltd., Guangdong (CN)

( * ) Notice: Subject to any disclaimer, the term of this patent is extended or adjusted under 35 U.S.C. 154(b) by 40 days.

(21) Appl. No.: 15/502,371

(22) PCT Filed: Jan. 26, 2016

(86) PCT No.: PCT/CN2016/072086
§ 371 (c)(1),
(2) Date: Feb. 7, 2017

(87) PCT Pub. No.: WO2016/165445
PCT Pub. Date: Oct. 20, 2016

(65) Prior Publication Data

US 2017/0234510 A1 Aug. 17, 2017

(30) Foreign Application Priority Data

Apr. 11, 2015 (CN) ..... 2015 2 0214576 U

(51) Int. Cl.
*F21V 5/02* (2006.01)
*F21V 14/06* (2006.01)
(Continued)

(52) U.S. Cl.
CPC ..... *F21V 14/06* (2013.01); *F21V 5/008* (2013.01); *F21V 5/02* (2013.01); *F21W 2131/406* (2013.01)

(58) Field of Classification Search
CPC . F21V 5/02; F21V 5/008; F21V 14/06; F21V 7/048; F21W 2131/406
See application file for complete search history.

(56) References Cited

U.S. PATENT DOCUMENTS 6,386,737 B1 5/2002 Hoppa
2006/0082692 A1* 4/2006 Kamijima ..... H04N 9/3105 349/5
2011/0048411 A1* 3/2011 Walker ..... F24J 2/085 126/698

FOREIGN PATENT DOCUMENTS

CN 203718626 7/2014
CN 203718626 U 7/2014
(Continued)

OTHER PUBLICATIONS

International Search Report, dated May 3, 2016; 4 pages.
(Continued)

*Primary Examiner* — Karabi Guharay
(74) *Attorney, Agent, or Firm* — Seyfarth Shaw LLP

(57) ABSTRACT

A double-prism assembly is disclosed, including a first prism and a second prism arranged in a coaxial manner, wherein the first prism has a first prism face structure, the second prism has a second prism face structure, and the first prism face structure and the second prism face structure are arranged in a same direction or in different directions. For the double-prism assembly, when a beam of light hits the bottom of the first prism, passes through the first prism face surface and the second prism face surface, and comes out of the double-prism assembly, two circles of spots arranged in a coaxial manner may be formed, with equally distributed spots, and each of the two circles of spots can freely rotate clockwise or anticlockwise, greatly increasing the style and effect of the spots, and enriching the stage effect and rendering effect. In addition, it is simple in structure and low
(Continued)

in cost. A multi-prism combinatorial structure and a light fixture are also disclosed.

8 Claims, 3 Drawing Sheets

(51) Int. Cl.
*F21V 5/00* (2018.01)
*F21W 131/406* (2006.01)

(56) References Cited

FOREIGN PATENT DOCUMENTS

| | | | | |
|---|---|---|---|---|
| CN | 203868942 | | | 10/2014 |
| CN | 203868942 | U | * | 10/2014 |
| CN | 204629370 | | | 9/2015 |
| CN | 204629370 | U | | 9/2015 |
| CN | 105042519 | A | | 11/2015 |
| CN | 105142519 | | | 11/2015 |
| EP | 0389724 | | | 10/1990 |

OTHER PUBLICATIONS

Extended European Search Report and Written Opinion for parallel European Patent Application No. 16779420.5, dated Dec. 5, 2018 (Official Copy only), 8 pages.
International Search Report for Application No. PCT/CN2016/072086 dated May 3, 2016, 2 pages.
Written Opinion for Application No. PCT/CN2016/072086 dated May 3, 2016, 6 pages.

* cited by examiner

DOUBLE-PRISM ASSEMBLY, MULTI-PRISM COMBINATORIAL STRUCTURE AND LIGHT FIXTURE

CROSS REFERENCE TO RELATED APPLICATIONS

This is a National Stage application of PCT/CN2016/0702086, filed Jan. 26, 2016, and claims priority to Chinese Patent Application Serial No. CN 20150214576.8, filed Apr. 11, 2015, the disclosures of which are incorporated herein by reference.

FIELD

The present disclosure relates generally to the technical field of lighting equipment for a stage, and specifically to a double-prism assembly, a multi-prism combinatorial structure and a light fixture.

BACKGROUND

At present, with the development of the stage light fixture industry, the spot effect produced by stage intelligent lights tends to be more diverse, so the application of the stage light fixture is becoming more and more extensive. The prism has become an indispensable element in the stage light fixture. A single beam of light or a single pattern can produce a plurality of spots or a rotation effect of the spots through the prism, to greatly enrich the stage effect and rendering effect.

However, the effect of the using of a single prism tends to have limitations that each of the size and style of the spot is simple. For example, a double-prisms combination for a stage light fixture has been proposed, which can not only present an effect produced by an eight-prism, but also present a composite effect of 24 beams of light produced by a combination of one eight-prism and one sixteen-prism. However, the style of the spots produced in this way is shown as a circle of spots, such that the style of the spots is relatively single and fixed, which may have a great influence on the effect of the stage light fixture.

SUMMARY

Based on this, it an objective of the present disclosure to provide a double-prism assembly, a multi-prism combinatorial structure and a light fixture, with rich spot styles, good effect, a simple structure and low cost, to overcome the defects in the prior art.

According to one aspect of the present disclosure, a double-prism assembly is provided, including a first prism and a second prism arranged in a coaxial manner, wherein the first prism has a first prism face structure, the second prism has a second prism face structure, and the first prism face structure and the second prism face structure are arranged in a same direction or in different directions.

In one embodiment, the first prism is a conical structure, the first prism face structure is arranged on a lateral side of the conical structure, and the first prism face structure includes a plurality of first prism face units extending from a bottom face of the conical structure to a vertex of the conical structure.

In one embodiment, the number of the plurality of first prism face units is in a range of 2 to 100.

In one embodiment, the second prism is a truncated conical structure, the second prism face structure is arranged on a lateral side of the truncated conical structure, and the second prism face structure includes a plurality of second prism face units extending from a bottom face of the truncated conical structure to a top face of the truncated conical structure.

In one embodiment, the number of the plurality of second prism face units is in a range of 2 to 100.

In one embodiment, the top face of the truncated conical structure is in a shape of a polygon, the number of sides of the polygon is the same as that of the plurality of second prism face units.

In one embodiment, each of the first prism face structure and the second prism face structure is provide with a coating structure.

According to another aspect of the present disclosure, a multi-prism combinatorial structure assembled by the double-prism assembly is provided, including a plurality of double-prism assemblies each of which is mentioned above arranged in a coaxial manner.

In one embodiment, the multi-prism combinatorial structure further includes at least one third prism, and the at least one third prism and the plurality of double-prism assemblies are arranged alternately.

According to a further aspect of the present disclosure, a light fixture is provided, including the above double-prism assembly, a fixed support assembly and a lamp cover, wherein the fixed support assembly includes a first fixed support and a second fixed support, the first prism is fixed to the first fixed support, the second prism is fixed to the second fixed support, and each of the first fixed support and the second fixed support is perpendicular to an optical axis, and rotatably fixed mounted within the lamp cover.

The present disclosure has the following beneficial effects.

The above double-prism assembly has a first prism with a first prism face structure, and a second prism with a second prism face structure, and the first prism face structure and the second prism face structure are arranged in a same direction, so that when a beam of light hits the bottom of the first prism, passes through the first prism face surface and the second prism face surface, and comes out of the double-prism assembly, two circles of spots arranged in a coaxial manner may be formed, with equally distributed spots, and each of the two circles of spots can freely rotate clockwise or anticlockwise, greatly increasing the style and effect of the spots, and enriching the stage effect and rendering effect. In addition, it is simple in structure and low in cost.

The above light fixture is designed to mount the above double-prism assembly within the lamp cover so that when a beam of light hits the bottom of the first prism, passes through the first prism face surface and the second prism face surface, and comes out of the double-prism assembly, two circles of spots arranged in a coaxial manner may be formed, with equally distributed spots, and each of the two circles of spots can freely rotate clockwise or anticlockwise, greatly increasing the style and effect of the spots, and enriching the stage effect and rendering effect. In addition, it is simple in structure and low in cost.

The above multi-prism combinatorial structure is designed to arrange a plurality of double-prism assemblies in a coaxial manner, so that when a beam of light hits the bottom of the first prism, passes through the first prism face surface and the second prism face surface, and comes out of the double-prism assembly, two circles of spots arranged in a coaxial manner may be formed, with equally distributed spots, and each of the two circles of spots can freely rotate clockwise or anticlockwise, greatly increasing the style and effect of the spots, and enriching the stage effect and rendering effect. In addition, it is simple in structure and low in cost.

DESCRIPTION OF REFERENCE SIGNS

100 first prism, 120 first prism face structure, 122 first prism face unit, 200 second prism, 220 second prism face structure, 222 second prism face unit, 300 fixed support assembly, 320 first fixed support, 340 second fixed support, and 400 lamp cover.

DETAILED DESCRIPTION OF THE PREFERRED EMBODIMENTS

The preferred embodiments of the present disclosure are detailed below.

Figure 1:
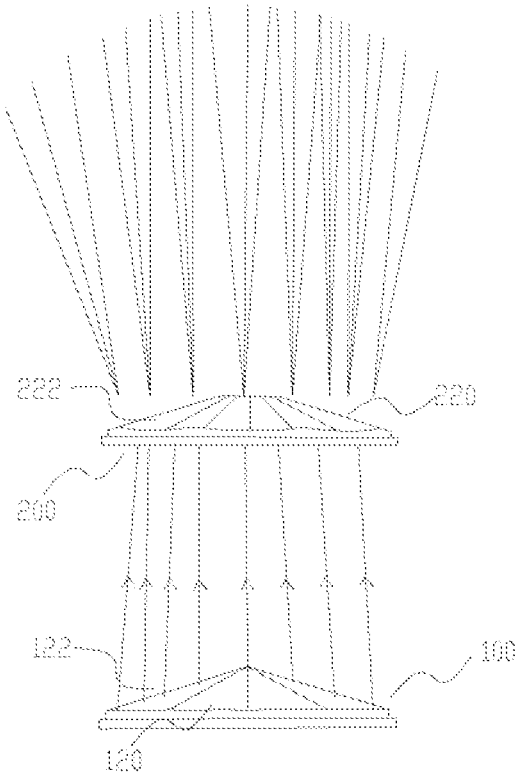
FIG. 1 is a structural schematic diagram illuminating a double-prism assembly according to one embodiment of the present disclosure.
Figure 2:
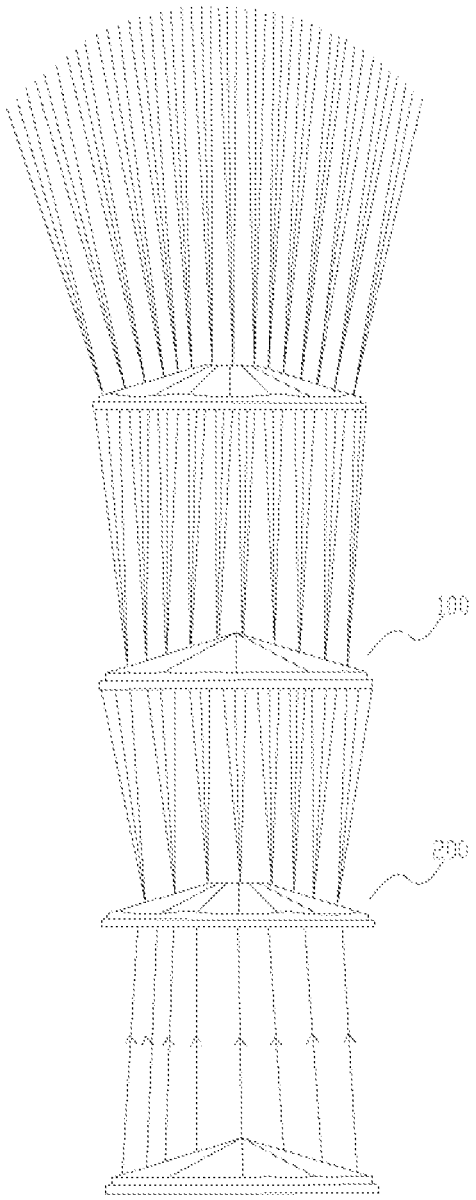
FIG. 2 is a structural schematic diagram illuminating a multi-prism combinatorial structure according to one embodiment of the present disclosure.
Figure 3:
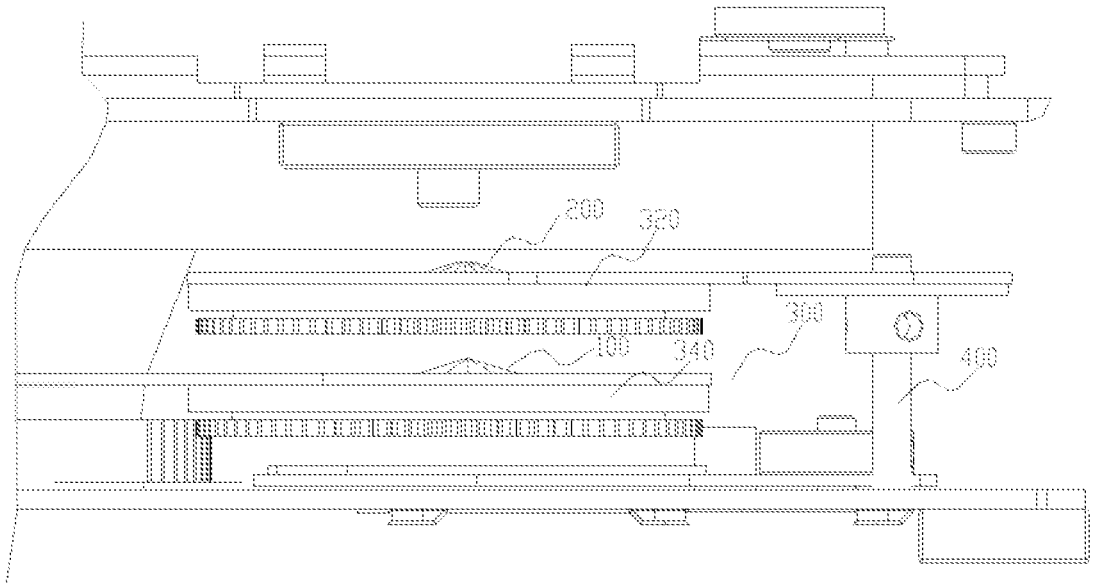
FIG. 3 is a structural schematic diagram illuminating a light fixture according to one embodiment of the present disclosure.

As shown in FIG. 1, a double-prism assembly is provided, including a first prism 100 and a second prism 200 arranged in a coaxial manner. The first prism 100 has a first prism face structure 120, the second prism 200 has a second prism face structure 220, and the first prism face structure 120 and the second prism face structure 220 are arranged in a same direction or in different directions.

The positions of the first prism 100 and the second prism 200 with respect to each other are arranged without any specific restriction, that is, the first prism 100 can be either below or above the second prism 200. In this way, when a beam of light hits the bottom of the first prism 100 or the second prism 200, passes through the first prism face surface 120 and the second prism face surface 220, and comes out of the double-prism assembly, two circles of spots arranged in a coaxial manner may be formed with equally distributed spots due to the difference in the structure, such as quantity and arrangement angle, between the first prism face surface 120 and the second prism face surface 220. Compared with the traditional prism combination which may only form a single circle of spots, the double-prism assembly according to the present disclosure may generate two circles of spots with more styles and better effect, greatly enriching the stage effect and rendering effect. In addition, it is simple in structure and low in cost.

Details of this embodiment are illustrated below. The first prism 100 is a cone of an eight-prism, and arranged at the bottom of the double-prism assembly to be close to the light outlet of the light source. The second prism 200 is a truncated-cone of a sixteen-prism, and arranged above the cone. When a beam of light hits the bottom of the cone, passes through the faces of the eight-prism and the faces of the sixteen-prism, two circles of spots may be formed. For the two circles of spots, the inner circle is a small circle with eight spots formed by the beams of light emerging from the top face of the truncated-cone, the outer circle is a large circle with twenty-four spots as a composite effect by the beam of light passing through the faces of the eight-prism and the faces of the sixteen-prism sequentially, and each of the small circle and the large circle can freely rotate clockwise or anticlockwise.

The first prism 100 is a conical structure, the first prism face structure 120 is arranged on a lateral side of the conical structure, and the first prism face structure 120 includes a plurality of first prism face units 122 extending from a bottom face of the conical structure to a vertex of the conical structure. The plurality of first prism tee units 122 around the lateral side of the conical structure form a plurality of edge planes which are closely connected with one another with no gap, so as to meet the refraction of the beam of light, in order not to affect the transmission path for the beam of light and the quality of the imaging pattern. All the edge planes of the cone and the truncated-cone are arranged upwards along the beam of light.

In addition, the number of the plurality of first prism face units 122 is in a range of 2 to 100. The number of the plurality of first prism face units 122 may be designed as any number in the range of 2 to 100, according to practical requirements, to greatly enrich the range of products, to generate different circles of spots with different sizes and shapes, to further enrich the stage effect.

Similarly, the second prism 200 is a truncated conical structure, the second prism face structure 220 is arranged on a lateral side of the truncated conical structure, and the second prism face structure includes a plurality of second prism face units 222 extending from a bottom face of the truncated conical structure to a top face of the truncated conical structure. The plurality of second prism face units 222 around the lateral side of the truncated conical structure form a plurality of edge planes which are closely connected with one another with no gap, so as to meet the refraction of the beam of light, in order not to affect the transmission path for the beam of light and the quality of the imaging pattern.

In addition, the number of the plurality of second prism face units 222 is in a range of 2 to 100. The number of the plurality of second prism face units 222 may be designed as any number in the range of 2 to 100, according to practical requirements, to greatly enrich the range of products, to generate different circles of spots with different sizes and shapes, to further enrich the stage effect.

The first prism 100 is a conical structure, with a circumferentially lateral side designed as a first prism face structure 120. The second prism 200 is a truncated conical structure, with a circumferentially lateral side designed as a second prism face structure 220. In practice use, the two prisms may be arranged into a stack in a coaxial manner, that is, both the two prisms have a same optical axis about which the two prisms rotate freely. It should be noted that the range of the number of each of the plurality of first prism face units 122 and the plurality of second prism face units 222 is only to illustrate but not limit the present disclosure. In other embodiments, other numbers may be used. In addition, the number of the plurality of first prism face units 122 may be the same as or different from that of the plurality of second prism face units 222, and the size of each of the plurality of first prism face units 122 may be the same as or different from that of each of the plurality of second prism face units 222.

The top face of the truncated conical structure is in a shape of a polygon, the number of sides of the polygon is the same as that of the plurality of second prism face units 222. The top face of the truncated conical structure being in a shape of a polygon means that, for example, if the number of the plurality of second prism face units 222 is 10, the top face of the truncated conical structure is in a shape of a regular decagon. In this way, the truncated conical structure can have a better the transmission path for the beam of light and a better imaging effect. In addition, since the size of each of the plurality of second prism face units 222 may be the same or different from the others, the polygon may be a regular polygon or a non-regular polygon accordingly.

Each of the first prism face structure 120 and the second prism tee structure 220 is provide with a coating structure. The coating structure may be a color coating of a variety of different colors. Each of the first prism face structure 120 and the second prism face structure 220 is provide with a color coating so that the color effect of the circle of spots can be further enriched to make the stage effect more colorful. The color of the coating on each of the first prism face structure 120 and the second prism face structure 220 may be the same or different. The color of each of the plurality of first prism face units 122 in the first prism face structure 120 may be the same or different. The color of each of the plurality of second prism face units 222 in the second prism face structure 220 may be the same or different. In addition, the color of each edge plane may be freely combined, which is not limited herein and just designed according to requirements of practical applications.

Further, the first prism 100 and the second prism 200 are the same in their cross section shapes. The maximum cross section shapes of the first prism 100 and the second prism 200 are designed to be the same so that the beam of light from the light source can completely reach the second prism 200 after passing through the first prism 100 and then form corresponding spots, improving the availability of the beam of light, to save energy cost. In this preferred embodiment, the shape and size of the bottom face of each of the first prism 100 and the second prism 200 are the same. In other embodiments, the size of another part may be the same.

A multi-prism combinatorial structure of the above double-prism assembly is also provided, including a plurality of double-prism assemblies each of which is mentioned above arranged in a coaxial manner.

The plurality of double-prism assemblies being arranged in a coaxial manner means that the multi-prism combinatorial structure may have an operating state that an even number of prisms are used together. Through mourning the above double-prism assembly within the lamp cover, when a beam of light hits the bottom of the first prism, passes through the first prism face surface and the second prism face surface, and comes out of the double-prism assembly, two circles of spots arranged in a coaxial manner may be formed, with equally distributed spots, and each of the two circles of spots can freely rotate clockwise or anticlockwise, greatly increasing the style and effect of the spots, and enriching the stage effect and rendering effect. In addition, it is simple in structure and low in cost.

Further, the multi-prism combinatorial structure further includes at least one third prism. The at least one third prism and the plurality of double-prism assemblies are arranged alternately. In this regard, the third prism may be arranged above or below the double-prism assembly, or arranged between the first prism 100 and the second prism 200, and the relative directions of the prism faces are not limited, so that the form of the structure of the product can be greatly enriched. In addition, in other embodiments, the number of the at least one third prism may be two or more, and be arranged alternately with the plurality of double-prism assemblies, which is not repeated herein.

A light fixture is further provided, including the above double-prism assembly, a fixed support assembly 300 and a lamp cover 400, wherein the fixed support assembly 300 includes a first fixed support 320 and a second fixed support 340, the first prism 100 is fixed to the first fixed support 320, the second prism 200 is fixed to the second fixed support 340, and each of the first fixed support 320 and the second fixed support 340 is rotatably fixed mounted within the lamp cover 400.

For the above multi-prism combinatorial structure, the plurality of double-prism assemblies is arranged in a coaxial manner. Specifically, the first prism 100 is mounted on the first fixed support 320 and rotates with the first fixed support 320, and the second prism 100 is mounted on the second fixed support 340 and rotates with the second fixed support 340, so that the spot image can rotate to improve the beauty of the stage. When a beam of light hits the bottom of the first prism 100, passes through the first prism face surface 120 and the second prism face surface 220, and comes out of the double-prism assembly, two circles of spots arranged in a coaxial manner may be formed, with equally distributed spots, and each of the two circles of spots can freely rotate clockwise or anticlockwise, greatly increasing the style and effect of the spots, and enriching the stage effect and rendering effect. In addition, it is simple in structure and low in cost. In other embodiments, the first prism 100 and the second prism 200 may be used alone.

Technical features of the above embodiments may be combined arbitrarily. For brief description, not all of the possible combinations of the technical features of the above embodiments are described, but it will be appreciated that these possible combinations belong to the scope of the present disclosure once there is no conflict between the technical features.

The above are embodiments of the present disclosure described in detail, and should not be deemed as limitations to the scope of the present disclosure. It should be noted that variations and improvements will become apparent to those skilled in the art to which the present disclosure pertains without departing from its spirit and scope. Therefore, the scope of the to present disclosure is defined by the appended claims.

What is claimed is:

1. A double-prism assembly, comprising:

first and second prisms arranged in a coaxial manner, wherein the first prism is a conical structure and has a first prism face structure arranged on a lateral side of the conical structure, and the first prism face structure includes first prism face units extending from a bottom face of the conical structure to a vertex of the conical structure, and wherein the second prism is a truncated conical structure and has a second prism face structure arranged on a lateral side of the truncated conical structure, and the second prism face structure includes second prism face units extending from a bottom face of the truncated conical structure to a top face of the truncated conical structure, and the first and second prism face structures are arranged in a same direction.

2. The double-prism assembly of claim 1, wherein there are 2 to 100 first prism face units.

3. The double-prism assembly of claim 1, wherein there are 2 to 100 second prism face units.

4. The double-prism assembly of claim 1, wherein the top face of the truncated conical structure is in a shape of a polygon having a number of sides that is the same as a number of the second prism face units.

5. The double-prism assembly of claim 1, wherein each of the first and second prism face structures includes a coating structure.

6. A multi-prism combinatorial structure assembled by the double-prism assembly of claim 1, comprising a plurality of the double-prism assemblies arranged in a coaxial manner.

7. The multi-prism combinatorial structure of claim 6, further comprising a third prism, wherein the third prism and the double-prism assemblies are arranged alternately.

8. A light fixture, comprising the double-prism assembly of claim 1, a fixed support assembly and a lamp cover, wherein the fixed support assembly includes first and second fixed supports, the first prism is fixed to the first fixed support, the second prism is fixed to the second fixed support, and each of the first and second fixed supports is perpendicular to an optical axis and rotatably mounted within the lamp cover.

* * * * *